US009080779B1

(12) United States Patent
Leonard

(10) Patent No.: US 9,080,779 B1
(45) Date of Patent: Jul. 14, 2015

(54) ROOF VENT

(76) Inventor: Jonathan Patrick Leonard, Cape Coral, FL (US)

( * ) Notice: Subject to any disclaimer, the term of this patent is extended or adjusted under 35 U.S.C. 154(b) by 445 days.

(21) Appl. No.: 13/595,940

(22) Filed: Aug. 27, 2012

(51) Int. Cl.
*F24F 7/02* (2006.01)
*F24F 11/00* (2006.01)

(52) U.S. Cl.
CPC ..... *F24F 7/02* (2013.01); *F24F 11/0001* (2013.01)

(58) Field of Classification Search
CPC ..... F24F 7/02; F24F 11/0001
USPC ..... 454/366, 340, 356, 359
See application file for complete search history.

(56) References Cited

U.S. PATENT DOCUMENTS

| | | | | | |
|---|---|---|---|---|---|
| 1,831,189 | A | * | 11/1931 | Obermark | 454/22 |
| 2,018,020 | A | * | 10/1935 | Guenther | 454/21 |
| 2,447,472 | A | * | 8/1948 | Donley | 454/366 |
| 2,565,131 | A | * | 8/1951 | Johnson | 454/366 |
| 2,741,972 | A | * | 4/1956 | Pryne | 454/27 |
| 3,094,915 | A | * | 6/1963 | Leigh | 454/366 |
| 3,200,735 | A | * | 8/1965 | Bergen | 454/366 |
| 3,250,206 | A | * | 5/1966 | Strouth | 454/359 |
| 3,430,550 | A | * | 3/1969 | Smith et al. | 454/18 |
| D257,282 | S | * | 10/1980 | Roberts | D23/373 |
| 4,890,546 | A | * | 1/1990 | Venge | 454/242 |
| 5,591,080 | A | * | 1/1997 | Ward | 454/359 |
| 5,632,678 | A | * | 5/1997 | Doelfel | 454/366 |
| 5,860,256 | A | * | 1/1999 | Humber | 52/219 |
| 6,155,008 | A | * | 12/2000 | McKee | 52/198 |
| 6,520,852 | B2 | * | 2/2003 | McKee et al. | 454/367 |
| 7,308,777 | B2 | * | 12/2007 | Sandow | 52/200 |
| 7,544,124 | B2 | * | 6/2009 | Polston | 454/367 |
| 2002/0108316 | A1 | * | 8/2002 | Miller | 52/60 |
| 2005/0005541 | A1 | * | 1/2005 | West | 52/198 |
| 2005/0148295 | A1 | * | 7/2005 | Koessler | 454/353 |
| 2007/0173191 | A1 | * | 7/2007 | Daniels et al. | 454/250 |
| 2011/0092148 | A1 | * | 4/2011 | Zibafar | 454/17 |

FOREIGN PATENT DOCUMENTS

CA 2326371 A1 * 5/2002

* cited by examiner

*Primary Examiner* — Steven B McAllister
*Assistant Examiner* — Frances F Hamilton
(74) *Attorney, Agent, or Firm* — Edward P Dutkiewicz

(57) ABSTRACT

A roof vent comprising several components. First there is a base plate for contacting an existing recipient surface, such as a building roof. Next there is a lower vent section coupled to the base plate. Lastly, there is an upper vent section coupled to the upper extent of the lower vent section. The roof vent has a flapper and a exclusion screen.

8 Claims, 9 Drawing Sheets

ROOF VENT

BACKGROUND OF THE INVENTION

Rule 1.78 (F) (1) Disclosure

The Applicant has not submitted a related pending or patented non-provisional application within two months of the filing date of this present application. The invention is made by a single inventor, so there are no other inventors to be disclosed. This application is not under assignment to any other person or entity at this time.

FIELD OF THE INVENTION

The present invention relates to a roof vent and more particularly pertains to a device for venting gases from a building.

DESCRIPTION OF THE PRIOR ART

The use of roof vents is known in the prior art. More specifically, vents previously devised and utilized for the purpose of venting gases from a building are known to consist basically of familiar, expected, and obvious structural configurations, notwithstanding the myriad of designs encompassed by the crowded prior art which has been developed for the fulfillment of countless objectives and requirements.

While the prior art devices fulfill their respective, particular objectives and requirements, the prior art does not describe a roof vent that has the particular configuration described in this patent application.

In this respect, the roof vent according to the present invention substantially departs from the conventional concepts and designs of the prior art, and in doing so provides an apparatus primarily developed for the purpose of allowing a user to vent gases from a building.

Therefore, it can be appreciated that there exists a continuing need for a new and improved roof vent which can be used for venting gases from a building. In this regard, the present invention substantially fulfills this need.

SUMMARY OF THE INVENTION

In view of the foregoing disadvantages inherent in the known types of vents now present in the prior art, the present invention provides an improved roof vent. As such, the general purpose of the present invention, which will be described subsequently in greater detail, is to provide a new and improved roof vent and method which has all the advantages of the prior art and none of the disadvantages.

To attain this, the present invention essentially comprises a roof vent, comprising several components, in combination.

First, there is a base plate. The base plate contacts, and is coupled to, an existing recipient surface, such as a roof of a structure. The base plate is fabricated of a rigid material, such as plastic, but may be made of a flexible material, such as rubber or plastic, such that the material has some "give" or bendability. This allows the material to readily conform to the surface it is applied to, such as a roof. The base plate has a generally planar configuration with an upper surface, a lower surface, and a thickness there between.

The base plate has two parallel side edges, a front edge, and an rear edge. The rear edge is varied and the front edge being generally straight. By "varied" is meant that the edge does not track a straight path from side to side, but rather varies from this line and forms a bent, or "non straight" course of travel.

The varied rear edge has a generally chevron shape. The varied rear edge has a generally chevron shape.

The base plate has a generally rectilinear shaped passageway there through. The passageway forms an opening through the base plate. The base plate passageway has a first length and a first width.

Next, there is a lower vent section. The lower vent section is coupled to the base plate. The lower vent section has a rear face, a front face, a pair of mirror image side faces, and an upper extent. The rear face has a length formed by an upper edge and a lower edge. The rear face has a width formed by a pair of side faces. The rear face has an inner surface and an outer surface. The rear outer surface is oriented at a first obtuse angle relative to the upper surface of the base plate.

The lower vent section rear face lower edge has a mid point. The mid point forms a protrusion. The protrusion is sloped from an area adjacent a midpoint of the upper edge to the midpoint of the lower edge. The rear face upper edge of the lower vent section has a receiving step therein. The midpoint is considered to be that location where the location is equidistant from either end. Adjacent means near to, but not at, that location. Adjacent means near to.

The front face has a length formed by an upper edge and a lower edge. The front face has a width formed by a pair of side edges. The front outer surface is oriented at a second obtuse angle relative to the upper surface of the base plate. The first obtuse angle is lesser than the second obtuse angle.

Each side face has a length formed by an upper edge and a lower edge. Each side face has a width formed by a pair of side edges. Each side face has an inner surface and an outer surface. Each side face has a parallelogram configuration. The upper edge has a first length, and the lower edge has a second length. The second length being greater than the first length. Each of the side surface side edges lie in intersecting planes. Each lower section side face is at an obtuse angle relative to the base plate. Each side face upper edge has a pair of slots therein, with each slot having a downwardly oriented lip.

The front face, the rear face, and the side faces form a passageway through the lower section. The passageway has a taper running from the base plate to the upper extent of the lower section. A taper means that the passageway through the lower vent section is narrower at the top of the passageway than that of the bottom of the passageway. The top of the passageway is the uppermost extent of the lower vent section. The bottom of the passageway is at the meeting of the base plate and the lower vent section.

Each upper edge of each lower vent section side face has a guiding tab protruding therefrom.

Next, there is an upper vent section. The upper vent section is coupled to the upper extent of the lower vent section. The upper vent section has a top face, a front under face, a rear under face, and a pair of mirror image side faces.

The top face has a curved planar configuration, with the curvature running from a forwardmost extent of the top face to a rearwardmost extent of the top face. The top face has an inner surface and an outer surface. The top face has a front edge, a rear edge, and a pair of curved side edges.

The upper vent section side faces each have a curved upper portion and a rectilinear lower portion. The curved upper portions of the each of the side faces of the upper vent section each couple the side face and the top face. The rectilinear lower portions of the each of the upper vent section side faces is continuous with each of the curved upper portions of the side faces of the upper vent section. The rectilinear lower portions of each of the side faces has a lower edge.

The rear under face is an opening which is defined by the rearwardmost extent of the top surface of the upper vent section, the lower edge of the upper vent section side faces, and a bottom edge of an intermediate member. The intermediate member also having a top edge. The rear edge and the side edges of the rear under face each having an outwardly oriented lip. The side edges each have a set of downwardly projecting pair of prongs. The pair of prongs is sized to be received by and mated with the lower section side face upper edge slots.

The front under face is an opening defined by the upper vent section top face forwardmost edge and the upper vent section side faces and the top edge of the intermediate member. The rearward most edge of the front under face is the top edge of the intermediate member. The intermediate member having a downwardly projecting rectilinear configuration. The intermediate member has a bottom edge and a pair of side edges. The intermediate member connects and bridges the front under face opening and the rear under face opening.

The inner surface of each side face of the upper vent section has a pivoting shaft. The pivoting shaft has a generally round tubular configuration. The inner surface of each side face of the upper vent section has a plurality of stiffening ribs.

There is a flapper having a generally rounded pivot. The pivot is configured to surround and be mated to each of the pivoting shafts of the inner surfaces of the side faces of the upper vent section, thereby allowing the rotation of the flapper. The flapper having a generally curved planar configuration.

Lastly, there is an excluding screen. The excluding screen is coupled to the front under face opening of the upper vent section.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved roof vent which has all of the advantages of the prior art vents and none of the disadvantages.

It is another object of the present invention to provide a new and improved roof vent which may be easily and efficiently manufactured and marketed.

It is further object of the present invention to provide a new and improved roof vent which is of durable and reliable constructions.

An even further object of the present invention is to provide a new and improved roof vent which is susceptible of a low cost of manufacture with regard to both materials and labor, and which accordingly is then susceptible of low prices of sale to the consuming public, thereby making such roof vent economically available to the buying public.

Even still another object of the present invention is to provide a roof vent for a device for venting gases from a building.

Lastly, it is an object of the present invention to provide a new and improved roof vent comprising several components, in combination. First there is a base plate for contacting an existing recipient surface, such as a building roof. Next there is a lower vent section coupled to the base plate. Lastly, there is an upper vent section coupled to the upper extent of the lower vent section. The roof vent has a flapper and a exclusion screen.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various Figures.

DESCRIPTION OF THE PREFERRED EMBODIMENT

Figure 1:
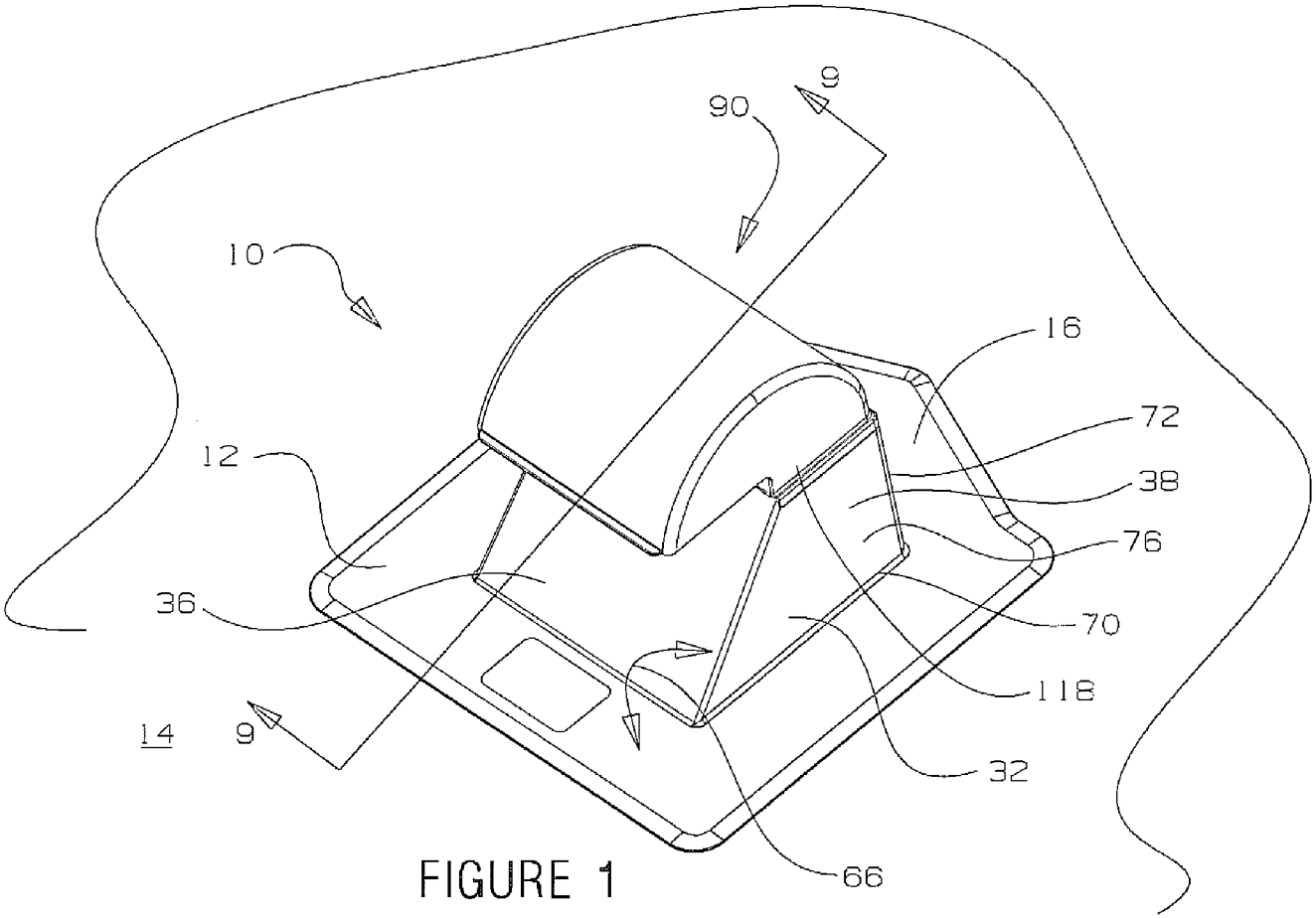
FIG. 1 is perspective view of the roof vent.
Figure 2:
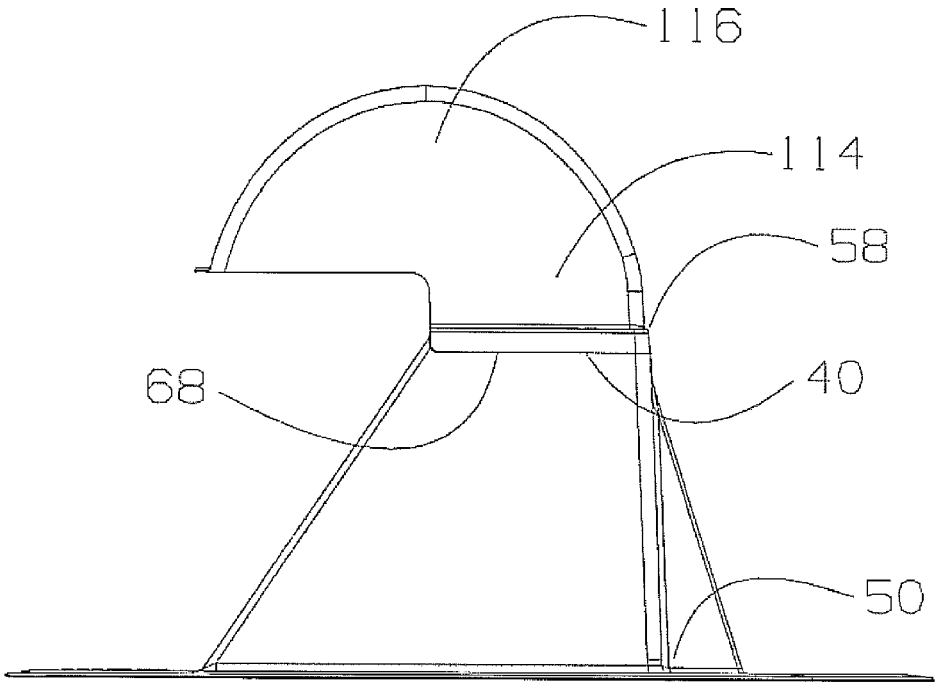
FIG. 2 is a right side elevational view.
Figure 3:
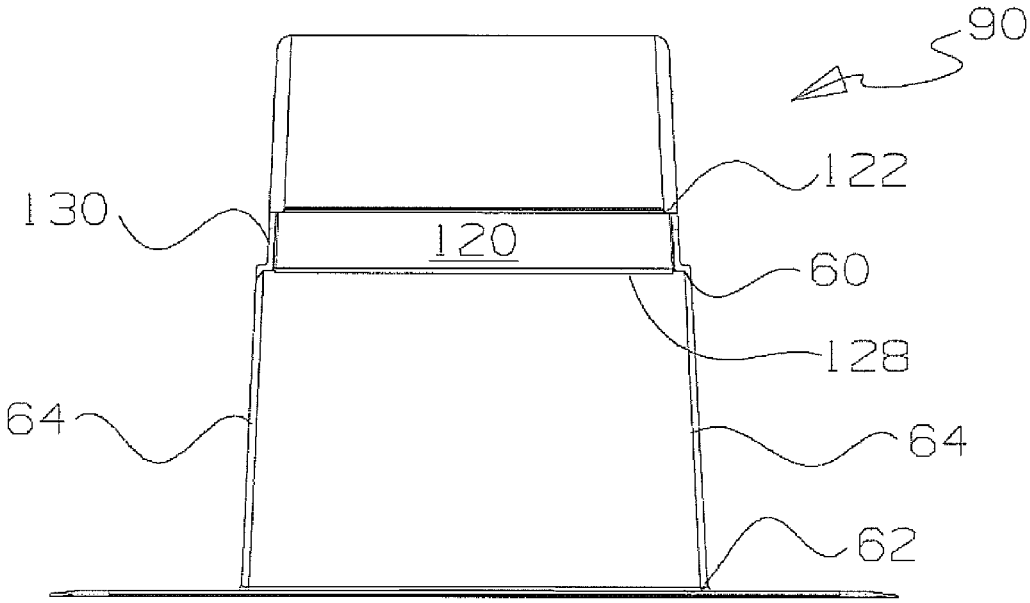
FIG. 3 is a front elevational view.
Figure 4:
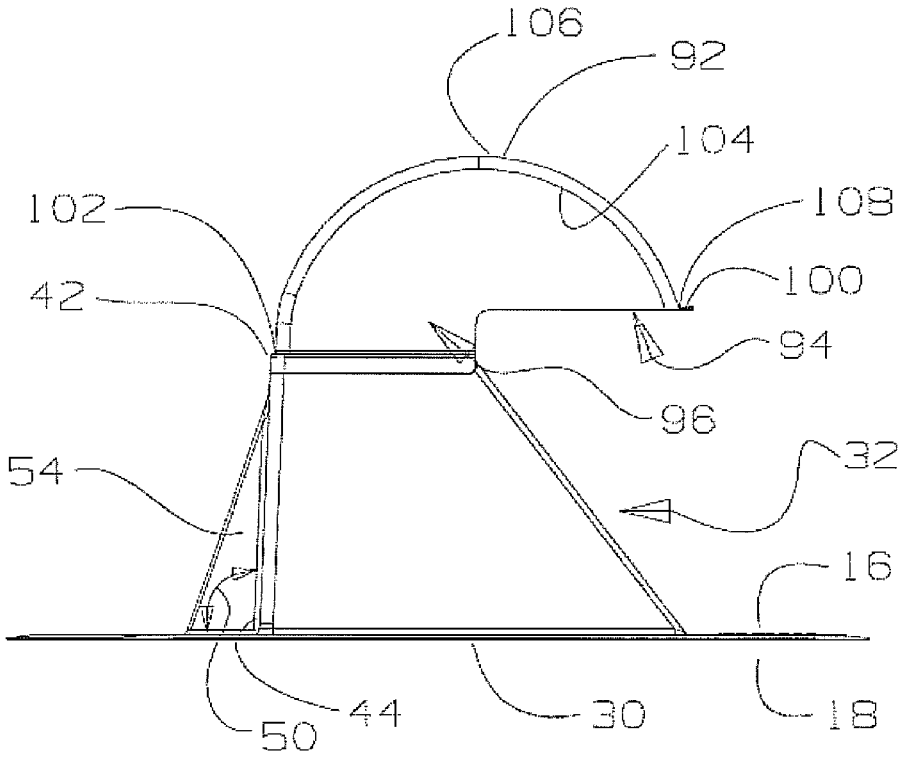
FIG. 4 is a left side elevational view.
Figure 5:
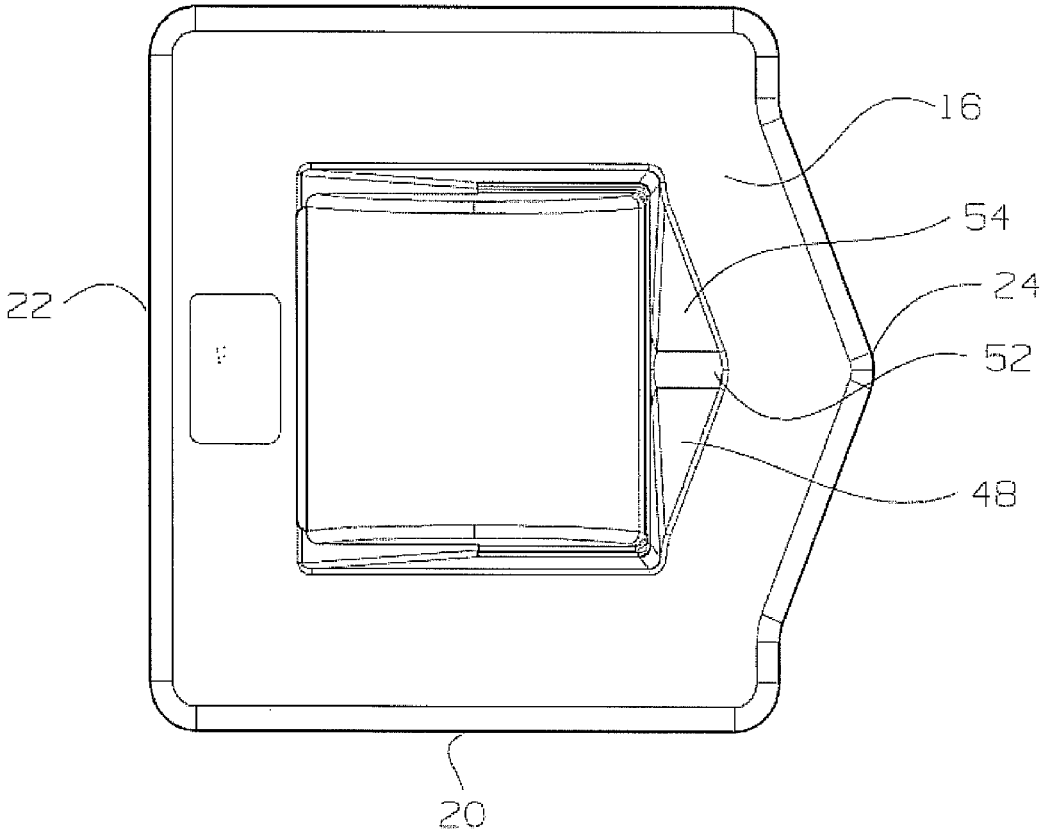
FIG. 5 is a top plan view of the roof vent.
Figure 6:
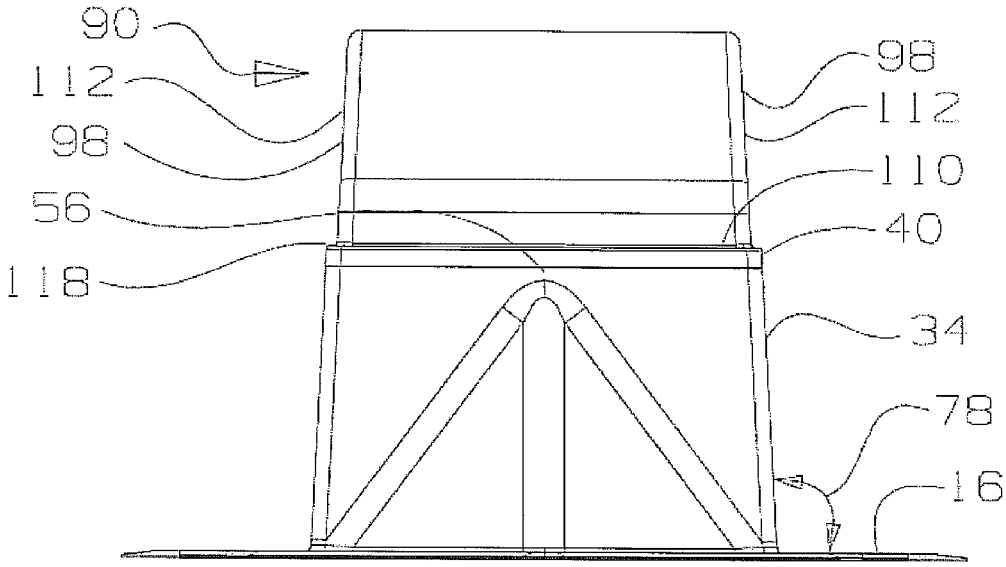
FIG. 6 is a rear elevational view of the roof vent.
Figure 7:
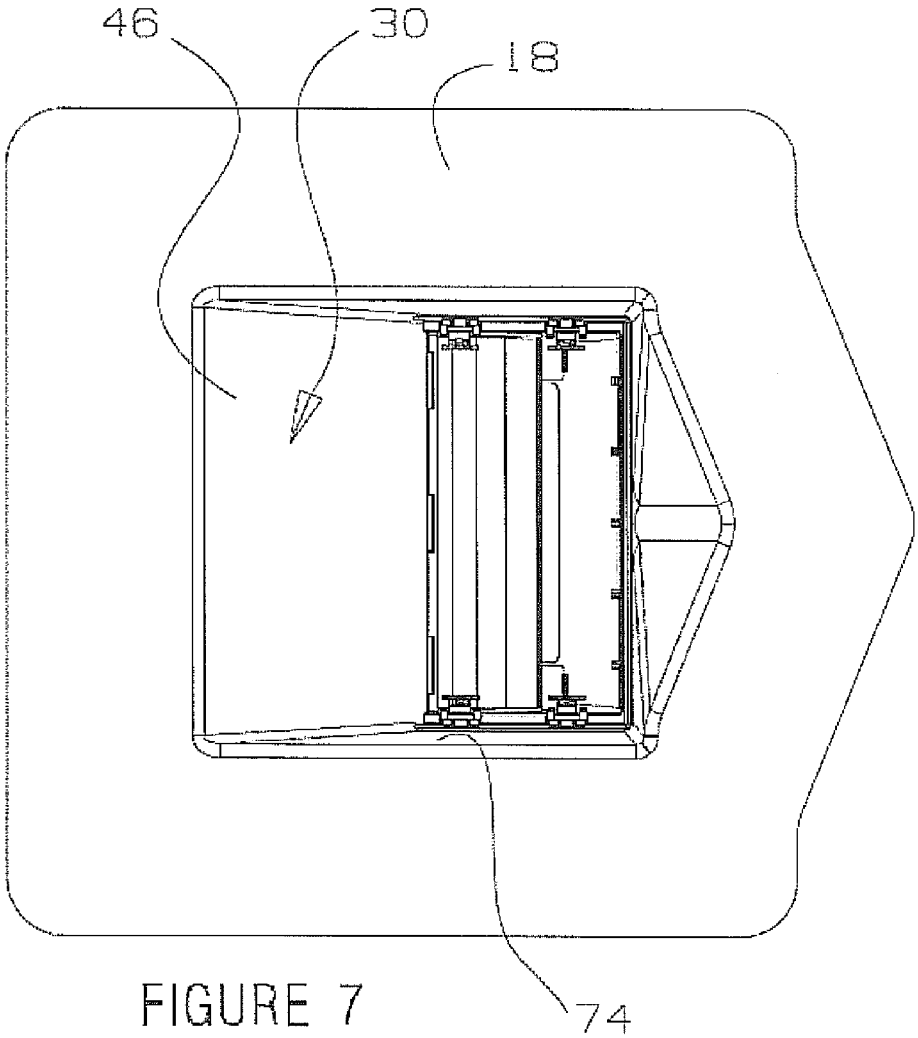
FIG. 7 is a bottom plan view.
Figure 8:
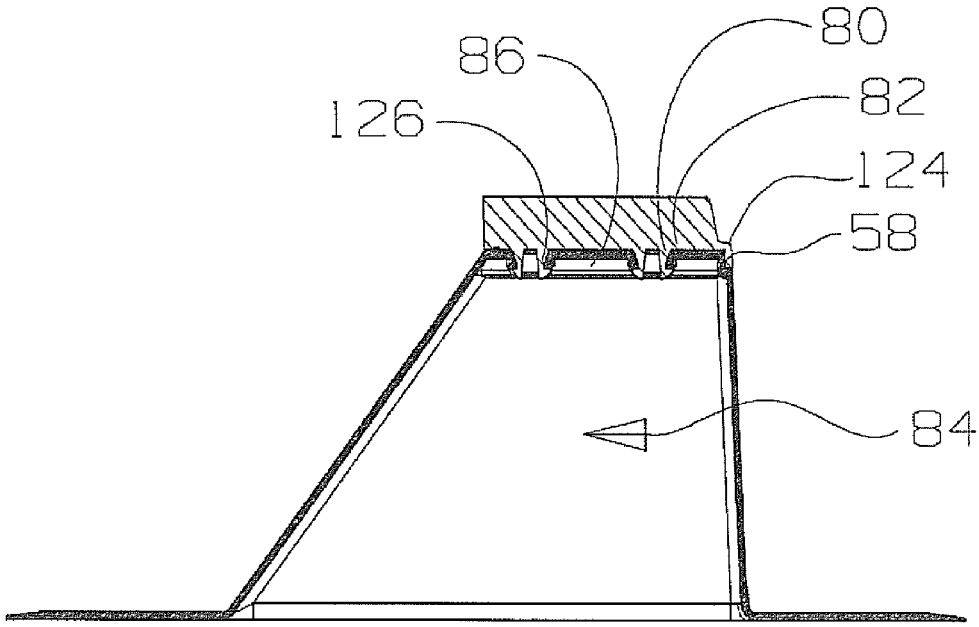
FIG. 8 is a close up cross section of the lower section, showing the side edge prongs which couple the upper section and the lower section.
Figure 9:
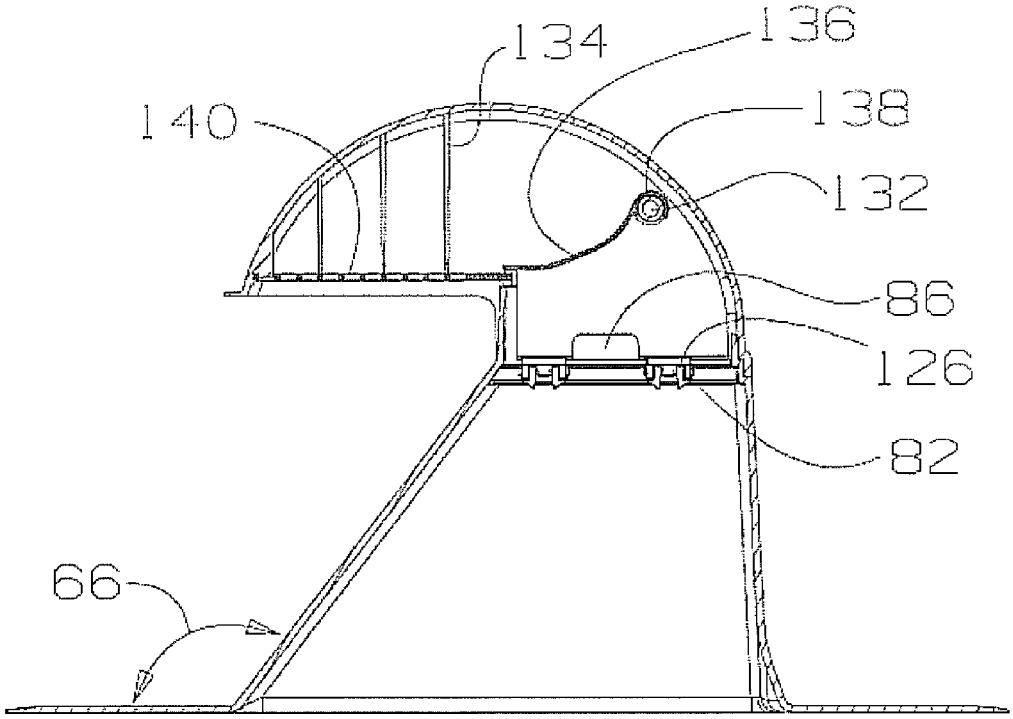
FIG. 9 is a view taken along line 9-9 of FIG. 1.

With reference now to the drawings, and in particular to FIG. 1 thereof, the preferred embodiment of the new and improved roof vent embodying the principles and concepts of the present invention and generally designated by the reference numeral 10 will be described.

The present invention, the roof vent 10 is comprised of a plurality of components. Such components in their broadest context include a base, a lower section, an upper section and a flapper. Such components are individually configured and correlated with respect to each other so as to attain the desired objective.

A roof vent 10 comprising several components, in combination.

First, there is a base plate 12. The base plate contacts, and is coupled to, an existing recipient surface 14, such as a roof of a structure. The base plate is fabricated of a rigid plastic, but may be made of a flexible material, such as rubber or plastic, such that the material has some "give" or bendability, in particular in the base, so as to allow the vent to be readily conformed to a roof line. This allows the material to readily conform to the surface it is applied to, such as a roof. The base plate has a generally planar configuration with an upper surface 16, a lower surface 18, and a thickness there between.

The base plate has two parallel side edges 20, a front edge 22, and an rear edge 24. The rear edge is varied and the front edge being generally straight. By "varied" is meant that the edge does not track a straight path from side to side, but rather varies from this line and forms a bent, or "non straight" course of travel.

The base plate has a generally rectilinear shaped passageway 30 there through. The passageway forms an opening through the base plate. The base plate passageway has a first length and a first width.

Next, there is a lower vent section 32. The lower vent section is coupled to the base plate. The lower vent section has a rear face 34, a front face 36, a pair of mirror image side faces 38, and an upper extent 40. The rear face has a length formed by an upper edge 42 and a lower edge 44. The rear face has a width formed by a pair of side faces. The rear face has an inner surface 46 and an outer surface 48. The rear outer surface is oriented at a first obtuse angle 50 relative to the upper surface of the base plate.

The lower vent section rear face lower edge has a mid point 52. The mid point forms a protrusion 54. The lower vent section rear face upper edge has a midpoint 56. The protrusion is sloped from an area adjacent a midpoint of the upper edge to the midpoint of the lower edge. The protrusion is oriented at an obtuse angle relative to the base plate upper surface. The rear face upper edge of the lower vent section has a receiving step 58 therein. The midpoint is considered to be that location where the location is equidistant from either end. Adjacent means near to, but not at, that location. Adjacent means near to.

The front face has a length formed by an upper edge 60 and a lower edge 62. The front face has a width formed by a pair of side edges 64. The front outer surface is oriented at a second obtuse angle 66 relative to the upper surface of the base plate. The first obtuse angle is lesser than the second obtuse angle.

Each side face has a length formed by an upper edge 68 and a lower edge 70. Each side face has a width formed by a pair of side edges 72. Each side face has an inner surface 74 and an outer surface 76. Each side face has a parallelogram configuration. The upper edge has a first length, and the lower edge has a second length. The second length being greater than the first length. Each of the side surface side edges lie in intersecting planes. Each lower section side face is at a third obtuse angle 78 relative to the base plate. Each side face upper edge has a pair of slots 80 therein, with each slot having a downwardly oriented lip 82.

The front face, the rear face, and the side faces form a passageway 84 through the lower section. The passageway has a taper running from the base plate to the upper extent of the lower section. A taper means that the passageway through the lower vent section is narrower at the top of the passageway than that of the bottom of the passageway. The top of the passageway is the uppermost extent of the lower vent section. The bottom of the passageway is at the meeting of the base plate and the lower vent section.

Each upper edge of each lower vent section side face has a guiding tab 86 protruding therefrom, which helps to align the upper section and the lower section to allow the joining together of the two sections.

Next, there is an upper vent section 90. The upper vent section is coupled to the upper extent of the lower vent section. The upper vent section has a top face 92, a front under face 94, a rear under face 96, and a pair of mirror image side faces 98.

The top face has a curved planar configuration, with the curvature running from a forwardmost extent 100 of the top face to a rearwardmost extent 102 of the top face. The top face has an inner surface 104 and an outer surface 106. The top face has a front edge 108, a rear edge 110, and a pair of curved side edges 112.

The upper vent section side faces each have a curved upper portion 114 and a rectilinear lower portion 116. The curved upper portions of the each of the side faces of the upper vent section each couple the side face and the top face. The rectilinear lower portions of the each of the upper vent section side faces is continuous with each of the curved upper portions of the side faces of the upper vent section. The rectilinear lower portions of each of the side faces has a lower edge 118.

The rear under face is an opening which is defined by the rearwardmost extent of the top face of the upper vent section, the lower edge of the upper vent section side faces, and a bottom edge of an intermediate member 120. The intermediate member also having a top edge 122. The rear edge and the side edges of the rear under face each having an outwardly oriented lip 124. The side edges each have a set of downwardly projecting pair of prongs 126. The pair of prongs is sized to be received by and mated with the lower section side face upper edge slots.

The front under face is an opening defined by the upper vent section top face forwardmost edge and the upper vent section side faces and the top edge of the intermediate member. The rearward most edge of the front under face is the top edge of the intermediate member. The intermediate member having a downwardly projecting rectilinear configuration. The intermediate member has a bottom edge 128 and a pair of side edges 130. The intermediate member connects and bridges the front under face opening and the rear under face opening.

The inner surface of each side face of the upper vent section has a pivoting shaft 132. The pivoting shaft has a generally round tubular configuration. The inner surface of each side face of the upper vent section has a plurality of stiffening ribs 134.

There is a flapper 136 having a generally rounded pivot 138. The pivot is configured to surround and be mated to each of the pivoting shafts of the inner surfaces of the side faces of the upper vent section, thereby allowing the rotation of the flapper. The flapper having a generally curved planar configuration.

Lastly, there is an excluding screen 140. The excluding screen is coupled to the front under face opening of the upper vent section.

The advantages of the present roof vent are the angulations of the side faces as well as the front and rear faces, which allows for stacking during shipping. The protrusion acts to divert fluid, such as rainwater, around the vent. The construction industry refers to such a configuration as a cricket. Present vent structures do not have a cricket, but rely on the stamped sheet metal to prevent water intrusion. The protrusion (cricket) assists in diversion of water, and therefore functions to help prevent water intrusion.

The snaps, or prongs, which couple the upper section to the lower section, allow for the piecemeal shipping of the upper and lower section. The taper of the lower section allows "stacking" during shipping, saving space, and ultimately, costs, associated with shipping each piece.

The flapper provides for intermittent closure, so as to seal off the vent when exhaust gases are not being vented through the roof vent, to the outside of the building. The screen prevents large insects, such as hornets and bees, from entering the roof vent, and nesting therein. Also, the screen prevents the entry of larger animals, such as vermin or reptiles, into the vent and the building.

Lastly, the rear varied edge provides for a uniform sized "skirt", or base, allowing the proper flashing of the roofing material over the vent base.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A roof vent comprising, in combination:

a base plate for contacting an existing recipient surface, the base plate having an upper surface, the base plate having two parallel side edges and a front edge and an rear edge, the rear edge being generally chevron shaped and the front edge being generally straight, the base plate having a generally planar configuration, the base plate having a lower surface and a thickness between the upper surface of the base plate and lower surface of the base plate, the base plate having a generally rectilinear shaped passageway there through, forming an opening through the base plate, the base plate passageway having a first length and a first width;

a lower vent section coupled to the base plate, the lower vent section having an upper extent, the lower vent section having a rear face, with the rear face having an outer surface with an upper edge and a lower edge, the rear outer surface of the lower vent section being oriented at a first obtuse angle relative to the upper surface of the base plate, the lower edge of the rear face outer surface having a mid point and the upper edge of the rear face outer surface having a midpoint, with the mid point of the rear face lower edge forming a protrusion, the lower vent section protrusion being sloped outwardly from an area adjacent the midpoint of the upper edge to the midpoint of the lower edge;

the lower vent section having a front face and a pair of mirror image side faces, the rear face having a length formed by an upper edge and a lower edge and the rear face having a width formed by a pair of side faces, the rear face having an inner surface, the lower vent section having a front face with an inner surface and an outer surface, the front outer surface being oriented at a second obtuse angle relative to the upper surface of the base plate, the first obtuse angle being lesser than the second obtuse angle, each lower vent section side face having a length formed by an upper edge and a lower edge, each lower vent section side face having a width formed by a pair of side edges, each lower vent section side face having an inner surface and an outer surface, each lower vent section side face having a parallelogram configuration with the upper edge having a first length and the lower edge having a second length; and, an upper vent section coupled to the upper extent of the lower vent section, the upper vent section having a top face and a front under face and a rear under face and a pair of mirror image side faces, the upper vent section top face having a curved planar configuration with the curvature running from a forwardmost extent of the top face to a rearwardmost extent of the top face, the top face having an inner surface and an outer surface, the top face having a front edge and a rear edge and a pair of curved side edges, the upper vent section side faces having a curved upper portion and a rectilinear lower portion, the curved upper portions of the each of the side faces of the upper vent section each couple the side face and the top face, the rectilinear lower portions of the each of the upper vent section side faces is continuous with each of the curved upper portions of the side faces of the upper vent section; and, the upper vent section intermediate member having a bottom edge and a pair of side edges, the intermediate member connecting and bridging the front under face opening and the rear under face opening.

2. The roof vent as described in claim 1, with the roof vent further comprising:

the rear face upper edge of the lower vent section having a receiving step therein;

the lower vent section front face having a length formed by an upper edge and a lower edge and the front face having a width formed by a pair of side edges;

the rectilinear lower portions of each of the side faces has a lower edge, the upper vent section rear under face being an opening defined by the rearwardmost extent of the top surface of the upper vent section and the lower edge of the upper vent section side faces and an intermediate member having a top edge, with the rear edge and the side edges each having an outwardly oriented lip; and, the front under face of the upper vent section being an opening defined by the upper vent section top face forwardmost edge and the upper vent section side faces and the top edge of the intermediate member.

3. The roof vent as described in claim 2, with the roof vent further comprising the rearward most edge of the front under face of the upper vent section being the intermediate member, with the intermediate member having a downwardly projecting rectilinear configuration.

4. The roof vent as described in claim 3, with the roof vent further comprising:

the lower vent section side face second length being greater than the first length, each side surface side edges each lying in intersecting planes, each lower section side face being at an obtuse angle relative to the base plate; and, the upper vent section side face lower edges each having a pair of downwardly projecting double prongs.

5. The roof vent as described in claim 4, with the roof vent further comprising:

the base plate being fabricated of a flexible material;

each side face upper edge of the lower vent section having a pair of slots therein, with each slot having a downwardly oriented lip; and, the upper vent section side face, lower edge pairs of prongs being sized to be received by and mated with the lower section side face upper edge slots.

6. The roof vent as described in claim 5, with the roof vent further comprising:

the lower vent section front face and lower vent section rear face and lower vent section side faces forming a passageway through the lower section, with the passageway having a taper running from the base plate to the upper extent of the lower section; and, the inner surface of each side face of the upper vent section having a pivoting shaft having a generally round tubular configuration, the inner surface of each side face of the upper vent section having a plurality of stiffening ribs.

7. The roof vent as described in claim 6, with the roof vent further comprising:

each upper edge of each lower vent section side face has a guiding tab; and, a flapper having a generally rounded pivot, the pivot configured to surround and be mated to each of the pivoting shafts of the inner surfaces of the side faces of the upper vent section.

8. The roof vent as described in claim 7, with the roof vent further comprising:

the flapper having a generally curved planar configuration; and, an excluding screen, the screen being coupled to the front under face opening.

* * * * *